US009670658B2

(12) United States Patent
Ishimaru et al.

(10) Patent No.: US 9,670,658 B2
(45) Date of Patent: Jun. 6, 2017

(54) WATER CLOSET DEVICE

(71) Applicant: TOTO LTD., Fukuoka (JP)

(72) Inventors: Ryoko Ishimaru, Kitakyushu (JP); Hidekazu Kitaura, Kitakyushu (JP); Takahiro Maruyama, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/040,284

(22) Filed: Feb. 10, 2016

(65) Prior Publication Data

US 2016/0237668 A1 Aug. 18, 2016

(30) Foreign Application Priority Data

Feb. 13, 2015 (JP) ..... 2015-026305

(51) Int. Cl.
*E04D 1/34* (2006.01)
*E03D 5/01* (2006.01)
*E03D 1/36* (2006.01)

(52) U.S. Cl.
CPC ..... *E03D 5/01* (2013.01); *E03D 1/36* (2013.01); *E03D 2201/40* (2013.01)

(58) Field of Classification Search
CPC ..... E03D 1/34
USPC ..... 4/300–442
See application file for complete search history.

(56) References Cited

FOREIGN PATENT DOCUMENTS

JP 2007-534867 A 11/2007
WO WO2005106141 A1 * 11/2005

* cited by examiner

*Primary Examiner* — Lori Baker
(74) *Attorney, Agent, or Firm* — Studebaker & Brackett PC

(57) ABSTRACT

A switching mechanism is configured to switch an advancing direction of water injected from a nozzle by moving between a first position and a second position. The switching mechanism is held at the second position by a force received from the water injected by the nozzle during the tank water feeding process. A refill mechanism has a refill pipe for causing the water injected from the nozzle during the tank water feeding process and whose advancing direction is switched by the switching mechanism to flow in through an inflow port on one end side. The refill pipe is configured to lead the water having flowed in through the inflow port to a toilet stool body without flowing through a suction port of a throat pipe.

6 Claims, 11 Drawing Sheets

WATER CLOSET DEVICE

BACKGROUND

Field

The present invention relates to a water closet device in which a toilet stool body is washed by washing water.

Description of Related Art

National Publication of International Patent Application No. 2007-534867 proposes a water closet device employing a jet pump unit as a water feeding mechanism. The water closet device described in National Publication of International Patent Application No. 2007-534867 includes a tank for storing water, and the jet pump unit is arranged in a state sunk inside the tank.

The jet pump unit has a throat pipe and a nozzle. A suction port is formed on one end of the throat pipe, while the other end is connected to a channel communicating with a bowl portion of the toilet stool body. When water is injected by the nozzle so as to flow into the throat pipe through the suction port, a jet pump action is induced, and thus, a large flow rate of water flows toward the bowl portion inside the throat pipe. Not only the water injected from the nozzle but the water stored inside the tank is also suctioned and flows through the throat pipe and thus, the large flow rate of water is supplied as washing water into the toilet stool body.

In such a jet-pump type water feeding mechanism, there is no need to store all the water to be supplied as the washing water to the toilet stool body inside the tank. Thus, as compared with a tank type water feeding mechanism for storing all the washing water in the tank, it has merits that a size of the tank can be made small and moreover, time required for filling the tank can be reduced. Moreover, even if the water closet device is installed in an environment with a relatively low water pressure in a water feed pipe such as a facility on a high floor, the large flow rate of water can be supplied to the toilet stool body. Furthermore, it also has a merit that a large-scale construction work for making a diameter of the water feed pipe large is not necessary.

In the water closet device described in National Publication of International Patent Application No. 2007-534867, continuous use is made possible by sequentially performing a washing process of supplying the washing water to the toilet stool body by increasing the flow rate of the water injected by the nozzle mainly by the jet pump unit and a tank water feeding process of supplying and storing the water injected by the nozzle mainly in the tank. In more detail, in the water closet device, a ball is arranged on an upstream side of the suction port in the throat pipe, and this ball opens the suction port during the washing process while it moves to cover the suction port during the tank water feeding process. By switching of an advancing direction of the water injected by the nozzle by this ball, the washing process and the tank water feeding process are performed.

In the water closet, a substantially U-shaped trap portion is formed, and water stored in this trap portion is used as sealing water for preventing a backflow of odor from a sewer pipe in general. Since this sealing water is discharged from the trap portion with waste and the washing water during the washing process, it is necessary to restore (refill) the sealing water after the washing process.

In the water closet device described in National Publication of International Patent Application No. 2007-534867, the sealing water is restored during the tank water feeding process performed after the washing process. In the water closet device, a part of the water injected by the nozzle during the tank water feeding process has its advancing direction switched by the ball into the tank and is supplied into the tank, while the remaining part goes around the ball and flows into the throat pipe on a downstream side. The water having flowed into the throat pipe is supplied into the water closet, and thus, at the same time as the supply of the water into the tank, the sealing water can be restored. At this time, the ball is held at a position closing the suction port by receiving a force from the upstream side by the water injected by the nozzle.

SUMMARY

However, in the water closet device described in National Publication of International Patent Application No. 2007-534867, during the tank water feeding process, the water injected by the nozzle goes around the ball and is also supplied to the downstream side and thus, the ball receives the force also from the downstream side. Therefore, a balance of forces acting on the ball is lost, and there is a concern that the ball cannot be held at the position closing the suction port any longer. As a result, there is a problem that supply of water into the tank and restoration of the sealing water cannot be performed reliably.

The present invention was made in view of such problem and has an object to provide a water closet device in which the toilet stool body is washed by the washing water and capable of performing supply of water into the tank by the jet pump unit and rapid restoration of the sealing water of the toilet stool body reliably.

In order to solve the aforementioned problem, a water closet device according to the present invention is a water closet device in which a toilet stool body is washed by washing water, including: the toilet stool body having a bowl portion for receiving waste and a trap portion for accepting the waste discharged from the bowl portion and storing water as sealing water; a tank for storing water inside; a jet pump unit arranged in a state at least partially sunk inside the tank, having a throat pipe having a suction port formed and arranged so that the water having flowed in through the suction port is supplied as the washing water to the toilet stool body and a nozzle for injecting water toward the inside of the throat pipe through the suction port and inducing a jet pump action for increasing a flow rate of the water flowing through the throat pipe more than the flow rate of the water injected by the nozzle; a switching mechanism for switching an advancing direction of the water injected by the nozzle so that a washing process of increasing the flow rate of the water injected by the nozzle mainly by the jet pump unit and supplying the water as the washing water to the toilet stool body and a tank water feeding process of supplying and storing the water injected by the nozzle mainly inside the tank are sequentially performed; and a refill mechanism for supplying water used as sealing water to the toilet stool body during the tank water feeding process, in which the switching mechanism is configured to switch the advancing direction by moving between a first position corresponding to the washing process and a second position corresponding to the tank water feeding process and is held at the second position by a force received from the water injected by the nozzle during the tank water feeding process, the refill mechanism has a refill pipe for causing the water injected from the nozzle during the tank water feeding process and whose advancing direction is switched by the switching mechanism to flow in through an inflow port on one end side, and the refill pipe is configured to lead the water having flowed in through the inflow port to the toilet stool body without flowing through the suction port of the throat pipe.

According to the present invention, the switching mechanism is to switch the advancing direction of the water injected by the nozzle and is held at the second position by receiving the force from the water during the tank water feeding process. Moreover, the refill mechanism restores the sealing water by leading the water whose advancing direction is switched during the tank water feeding process to the toilet stool body by the refill pipe. Since the refill pipe leads the water to the toilet stool body without flowing through the suction port of the throat pipe, such a situation does not occur that the switching mechanism receives the force from this water and the force for holding the switching mechanism at the second position lowers. As a result, during the tank water feeding process, the force of the water injected from the nozzle can be used efficiently for holding of the switching mechanism, the water whose advancing direction is switched is rapidly supplied to the toilet stool body, and supply of the water into the tank by the jet pump unit and rapid restoration of the sealing water can be reliably performed.

Moreover, in the water closet device according to the present invention, it is preferable that the inflow port is provided below a water level when the tank is full, and at least a part of the refill pipe is arranged above the water level when the tank is full.

In this preferred embodiment, by providing the inflow port below the water level when the tank is full, and by arranging at least a part of the refill pipe above the water level when the tank is full, discharge of the water stored in the tank through the refill pipe during time other than the tank water feeding process can be suppressed.

Moreover, in the water closet device according to the present invention, the refill mechanism preferably has a collecting portion formed having a tapered shape for collecting water whose advancing direction is switched by the switching mechanism and directing the water to the inflow port of the refill pipe.

During the tank water feeding process, the water whose advancing direction is switched by the switching mechanism is subjected to large resistance due to a rapid change of a channel sectional area when flowing into the inflow port of the refill pipe and its flow rate lowers. In the aforementioned preferred embodiment, by collecting the water by the collecting portion formed having a tapered shape, the change of the channel sectional area is alleviated so as to make the resistance small, whereby lowering of the flow rate of the water supplied as sealing water to the toilet stool body can be suppressed.

Moreover, in the water closet device according to the present invention, the refill mechanism preferably has a guide wall for leading the water whose advancing direction is switched by the switching mechanism to the inflow port of the refill pipe.

The water injected by the nozzle and whose advancing direction is switched by the switching mechanism advances through the water stored in the tank while being diffused. By means of such diffusion, a water force at the inflow port of the refill pipe is largely lowered and thus, the flow rate of the water to be supplied as the sealing water to the toilet stool body might be lowered.

Thus, in the aforementioned preferred embodiment, the water injected by the nozzle is made to flow along an outer side surface of the guide wall and is led to the inflow port of the refill pipe. As a result, diffusion of the water and the lowering of the water force at the inflow port of the refill pipe are suppressed, and the lowering of the flow rate of the water supplied as the sealing water to the toilet stool body can be suppressed.

Moreover, in the water closet device according to the present invention, the switching mechanism preferably switches the advancing direction at the second position so that the water injected from the nozzle advances in one direction.

In this preferred embodiment, by switching of the advancing direction by the switching mechanism so that the water injected from the nozzle advances in one direction, the lowering of the water force at the inflow port of the refill pipe due to the diffusion can be suppressed as compared with a case in which the water is made to advance in multiple directions. As a result, the lowering of the flow rate of the water supplied as the sealing water to the toilet stool body can be suppressed.

Moreover, in the water closet device according to the present invention, it is also preferable that the tank has an overflow port through which the overflow water is made to flow in if water is supplied when the tank is full and is configured such that the water having flowed into the refill pipe is supplied from the overflow port to the toilet stool body.

In this preferred embodiment, during the tank water feeding process, the sealing water can be restored by supplying water from the overflow port to the toilet stool body. That is, by using the overflow port used for preventing overflow of the tank, the sealing water can be restored without providing a separate exclusive opening.

DETAILED DESCRIPTION

Figure 1:
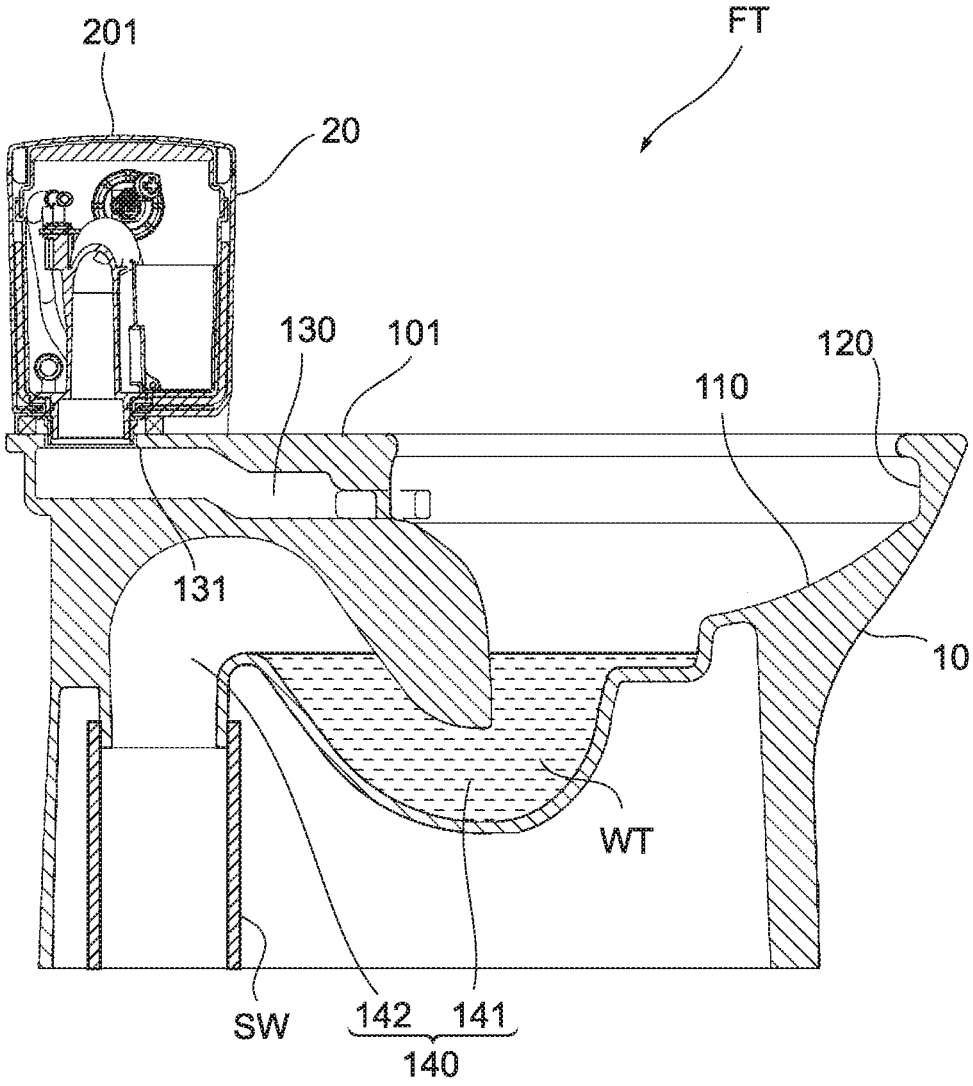
FIG. 1 is a sectional view illustrating a water closet device according to an embodiment of the present invention.

An embodiment of the present invention will be described below by referring to the attached drawings. In order to facilitate understanding of the description, the same reference numerals are given to the same constituent element in each drawing as much as possible, and duplicated description will be omitted.

Figure 2:
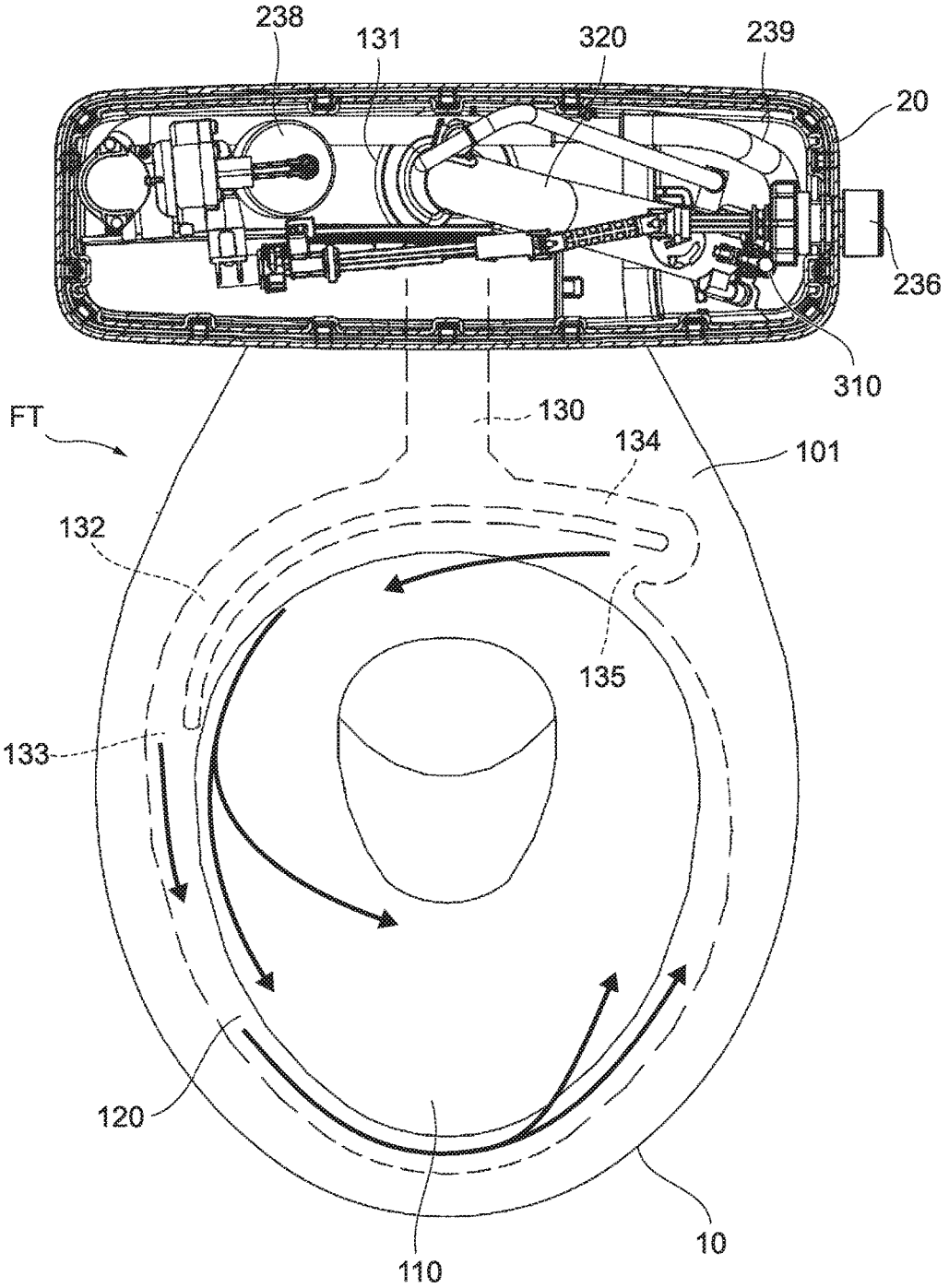
FIG. 2 is a top view of the water closet device illustrated in FIG. 1.

A water closet device according to the embodiment of the present invention will be described by referring to FIGS. 1 and 2. FIG. 1 is a sectional view of a water closet device FT and shows a section when the water closet device FT is cut on a plane perpendicular to its right-and-left direction. FIG. 2 is a top view of the water closet device FT. In FIG. 2, in order to illustrate an internal structure of a tank 20 which will be described later, a state in which an upper lid 201 of the tank 20 is removed is drawn.

As illustrated in FIGS. 1 and 2, the water closet device FT includes a toilet stool body 10 and the tank 20 installed on an upper surface 101 of the toilet stool body 10 on a rear side (left side in FIG. 1 and upper side in FIG. 2) of the toilet stool body 10. The water closet device FT is a device for receiving waste excreted by a user in the toilet stool body 10 and discharging the waste to a drain pipe SW by water (washing water) supplied from the tank 20.

In the following description, a right side (left side in FIG. 2) when seen from the user seated on the toilet stool body 10 is referred to as a "right side" and a left side when seen from the user seated on the toilet stool body 10 is referred to as a "left side" (right side in FIG. 2) unless otherwise noted. Moreover, a front side (right side in FIG. 1 and lower side in FIG. 2) when seen from the user seated on the toilet stool body 10 is referred to as a "front" or a "front side" and a rear side (left side in FIG. 1 and upper side in FIG. 2) when seen from the user seated on the toilet stool body 10 is referred to as a "rear" or a "rear side".

The toilet stool body 10 has a bowl portion 110, a rim portion 120, a conduit 130, and a drainage trap pipeline 140. The bowl portion 110 is a portion for temporarily receiving the waste dropped from above. The rim portion 120 is formed on an upper edge portion of the bowl portion 110 and as illustrated in FIG. 1, has such a shape that a part of an inner side surface of the bowl portion 110 is retreated toward an outer periphery side. As will be described later, the rim portion 120 is a channel through which water supplied toward the bowl portion 110 flows while swirling. The rim portion 120 is formed as a channel having a substantially circular shape (top view) making a circuit along an upper edge of the bowl portion 110.

The conduit 130 is a channel formed inside the toilet stool body 10 in order to lead the water supplied from the tank 20 to the bowl portion 110. The conduit 130 has its one end opened in an upper surface 101 of the toilet stool body 10 which becomes an inlet 131 of the water supplied from the tank 20. A position where the inlet 131 is formed is a portion on the rear side in the upper surface 101 of the toilet stool body 10 and a portion at the center in the right-and-left direction.

The conduit 130 branches to two channels (a first conduit 132 and a second conduit 134) on its downstream side. The first conduit 132 which is one of channels has an end portion on its downstream side opened on a right side portion in the rim portion 120, and the opening is an outlet of water (water discharge portion 133). When water is supplied from the tank 20 to the inlet 131, a part thereof flows through the first conduit 132 and spouts from the water discharge portion 133 and is supplied to the rim portion 120.

The second conduit 134 which is the other channel has an end portion on its downstream side opened in a portion on the left side and closer to the rear of the rim portion 120 and the opening is an outlet of water (water discharge portion 135). When the water is supplied from the tank 20 to the inlet 131, a part thereof flows through the second conduit 134 and spouts from the water discharge portion 135 and is supplied to the rim portion 120.

A direction in which the water spouts from the water discharge portion 133 is a direction along a circumference of the rim portion 120 formed as a substantially circular channel and is a counterclockwise direction on a top view. The direction in which the water spouts from the water discharge portion 135 is also a direction along a circumference of the rim portion 120 formed as a substantially circular channel and is a counterclockwise direction on a top view. As illustrated by an arrow in FIG. 2, the water spouting from the water discharge portion 133 and the water discharge portion 135 to the rim portion 120 flows down toward the bowl portion 110 from the entirety of the rim portion 120 while swirling counterclockwise along the rim portion 120.

The drainage trap pipeline 140 has a trap portion 141 and a descending channel 142. The trap portion 141 extends downward from a lower end of the bowl portion 110 and comes back and extends upward so as to present a substantial U-shape. The descending channel 142 is formed so as to have a falling gradient along a direction from an upper end of the trap portion 141 to a downstream. By means of such configuration, the trap portion 141 is capable of storing water, and sealing water WT is formed by the stored water. To a lower end of the descending channel 142, the drain pipe SW is connected. The drain pipe SW is a pipeline arranged inside a building and an end portion on its downstream side is connected to a sewer pipe, not shown.

When water is supplied from the tank 20 toward the bowl portion 110, as described above, the water flows down toward the bowl portion 110 from the entirety of the rim portion 120 while swirling counterclockwise along the rim portion 120. The water is added from above to the bowl portion 110 and is discharged from a lower end portion of the bowl portion 110 through the trap portion 141 and the descending channel 142. As a result, a downward flow is generated in the sealing water WT stored in the bowl portion 110.

The waste temporarily received by the bowl portion 110 is pushed in downward by the water supplied from the rim portion 120 above and moves toward the lower end of the bowl portion 110. After that, the waste goes through the trap portion 141 by the water flow and reaches the descending channel 142 and drops toward the drain pipe SW with the water.

Figure 3:
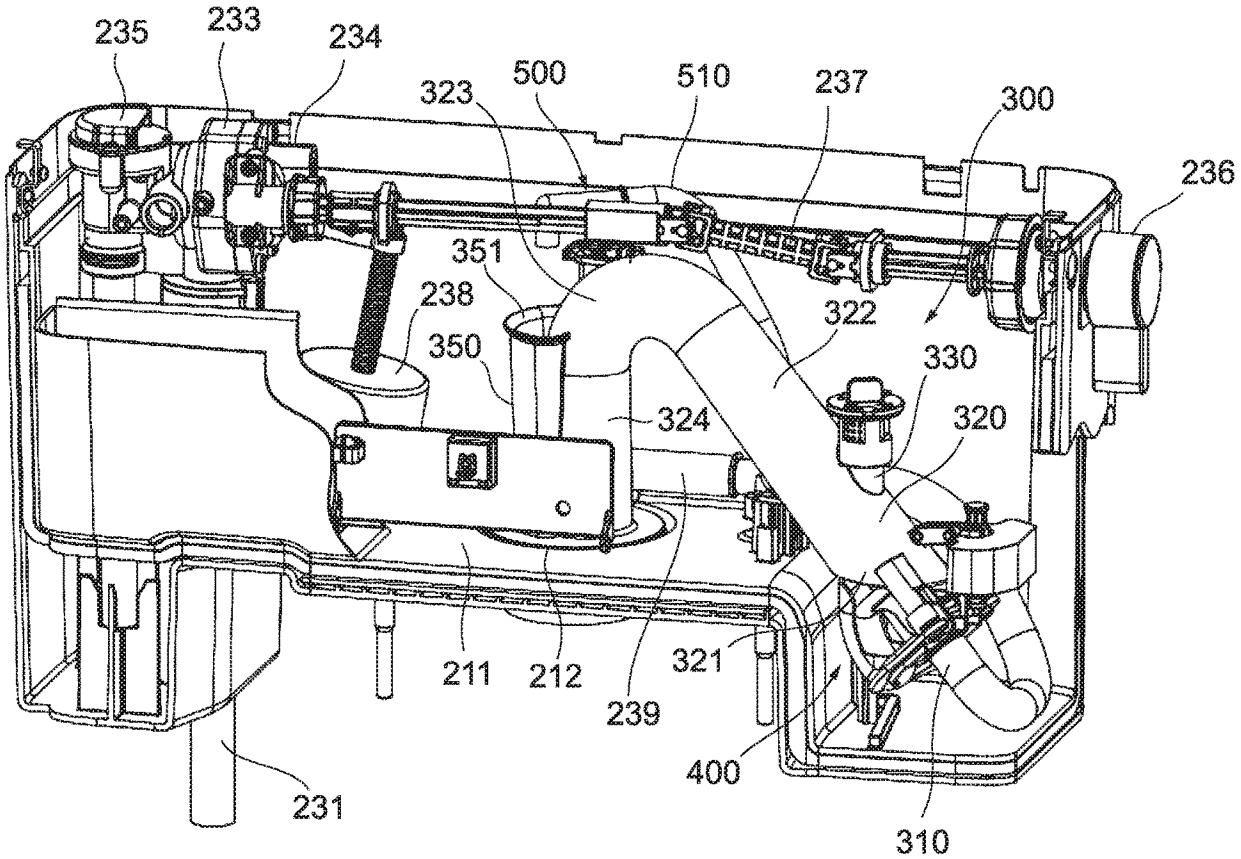
FIG. 3 is a view illustrating an inside of a tank of the water closet device illustrated in FIG. 1.
Figure 4:
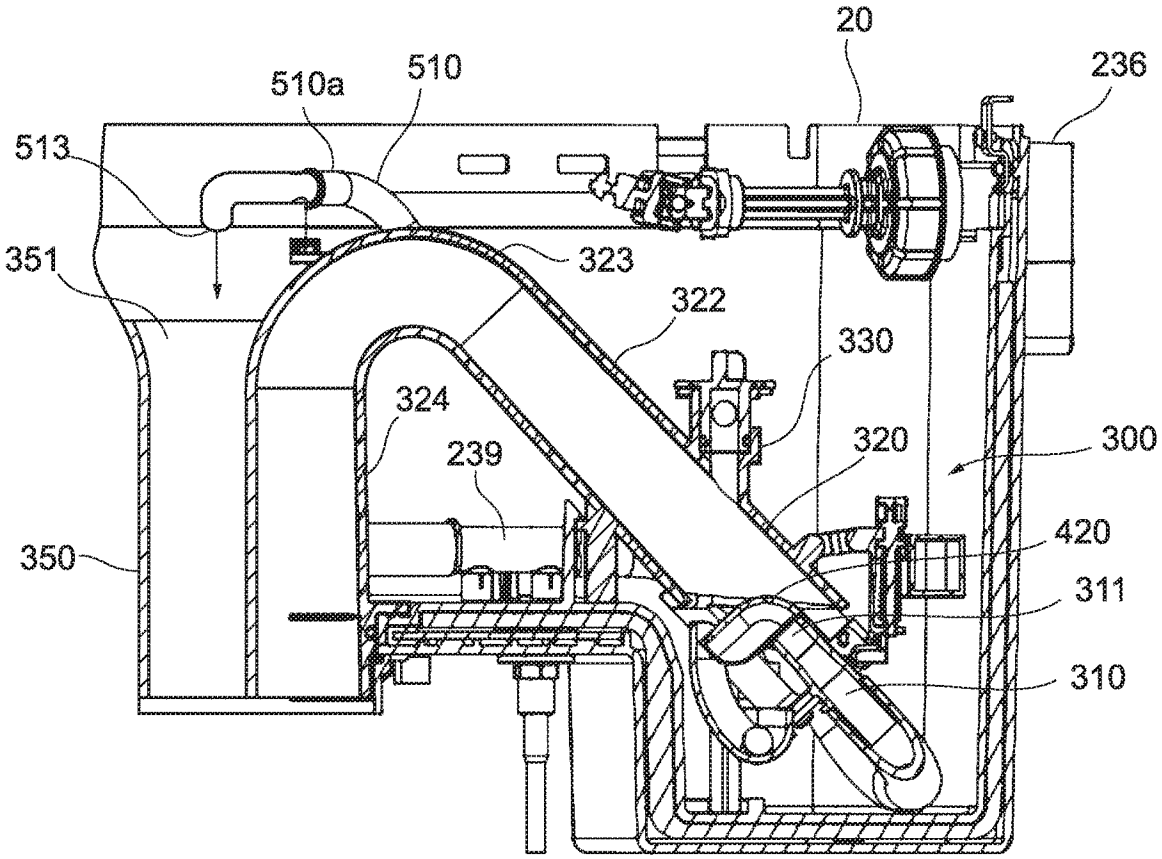
FIG. 4 is a sectional view illustrating a part of the inside of the tank of the water closet device illustrated in FIG. 1 in an enlarged manner.
Figure 5:
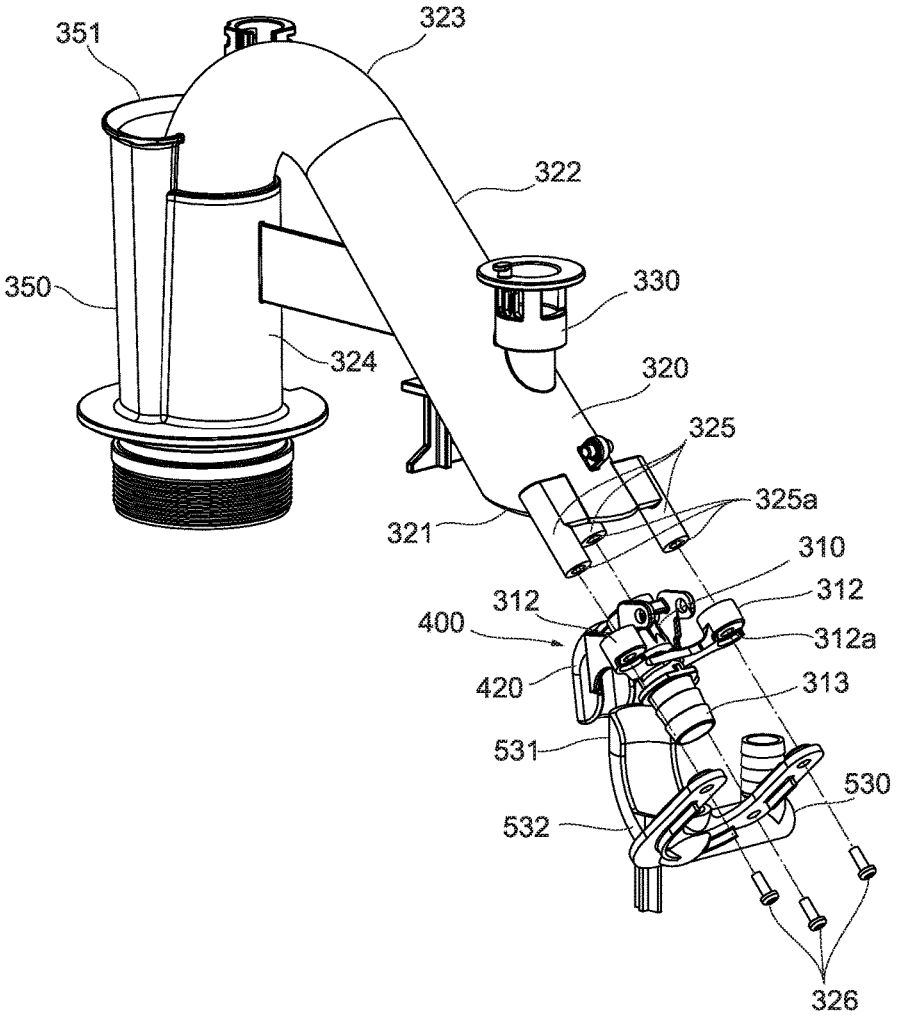
FIG. 5 is an exploded perspective view illustrating a periphery of a nozzle of the water closet device illustrated in FIG. 1.

Subsequently, by referring to FIGS. 3 to 5, the configuration inside the tank 20 will be described. FIG. 3 is a perspective view illustrating an inside of the tank 20 when the water closet device FT is seen from the front side. FIG. 4 illustrates a part of a section when the tank 20 is cut on a plane perpendicular to a longitudinal direction of the water closet device FT. FIG. 5 is an exploded perspective view illustrating a periphery of a nozzle 310 of the water closet device FT. As illustrated in FIG. 3, inside the tank 20, a water feed pipe 231, a main valve 233, a pilot valve 234, and a jet pump unit 300 are arranged.

The water feed pipe 231 is a pipe for supplying water toward the main valve 233 and is arranged so as to extend perpendicularly upward from below. A lower end of the water feed pipe 231 is connected to a water pipe, not shown, outside the tank 20. Moreover, an upper end of the water feed pipe 231 is connected to the main valve 233 from below in the tank 20.

In the middle of the water feed pipe 231 (between the water pipe and the main valve 233), a constant flow valve 232, not shown in FIG. 3, is arranged. In a state in which the main valve 233 is open, a flow rate of the water flowing into the main valve 233 is made constant by the constant flow valve 232 and does not fluctuate even if a water pressure in the water pipe rises.

The main valve 233 is an opening/closing valve and opens/closes the channel of water from the water feed pipe 231 toward the jet pump unit 300. A vacuum breaker 235 is arranged between the main valve 233 and the jet pump unit 300, and a backflow of the water by a negative pressure on an upstream side of the vacuum breaker 235 is prevented. The water feed pipe 231 extends upward as described above, and the main valve 233 and the vacuum breaker 235 are arranged at high positions in the tank 20. Thus, even in a state in which the tank 20 is full, the vacuum breaker 235 does not sink in the water.

The main valve 233 includes a pilot valve 234 and is configured such that opening/closing of the main valve 233 is switched by an operation of the pilot valve 234. To the pilot valve 234, a manual lever 236 arranged outside the tank 20 is connected through a transmission mechanism 237 arranged inside the tank 20. Moreover, to the pilot valve 234, a float 238 arranged inside the tank 20 is further connected.

When the manual lever 236 is operated by the user of the water closet device FT, the operation is transmitted to the pilot valve 234 through the transmission mechanism 237, and the pilot valve 234 is opened. As a result, the main valve 233 enters an open state, and water flows from the water feed pipe 231 toward the jet pump unit 300. As will be described later, the water having flowed toward the jet pump unit 300 during the washing process is supplied as the washing water together with the water stored inside the tank 20 to the conduit 130. Thus, a water level in the tank 20 gradually lowers.

Even after washing of the bowl portion 110 is finished, the main valve 233 is not closed, and water continuously flows from the water feed pipe 231 toward the jet pump unit 300. The water having flowed toward the jet pump unit 300 is supplied into the tank 20 and is stored for washing the next time. When the tank water feeding process of supplying water into the tank 20 as described above is performed, the water level inside the tank 20 gradually rises. The float 238 connected to the pilot valve 234 inside the tank 20 rises with the rise of the water level, whereby the pilot valve 234 is closed.

When the pilot valve 234 is closed, the main valve 233 enters a closed state, supply of water from the water feed pipe 231 to the jet pump unit 300 is stopped, and the tank water feeding process is finished. At this point of time, arrangement of the float 238 or the like has been adjusted so that the water stored inside the tank 20 becomes full for the washing the next time.

The jet pump unit 300 is for inducing a jet pump action by the water supplied from the water feed pipe 231 so as to supply water to the toilet stool body 10. The jet pump unit 300 has a nozzle 310 and a throat pipe 320.

The nozzle 310 is a tubular member having one end connected to the vacuum breaker 235 through a connection pipe 239, while an injection port 311 illustrated in FIG. 4 is formed on the other end. As illustrated in FIG. 5, the nozzle 310 has a connection portion 313 formed having a multi-stage tapered shape on its lower part, and by fitting this connection portion 313 in the connection pipe 239, the nozzle 310 and the connection pipe 239 are connected to each other. When the main valve 233 is opened, the water supplied from the water feed pipe 231 reaches the nozzle 310 through the connection pipe 239 and is injected as a high-speed water flow from the injection port 311. The injection port 311 has its injecting direction directed toward the inside of the throat pipe 320.

The throat pipe 320 is a pipe having a circular section and is arranged inside the tank 20 in a state in which a part thereof penetrates an opening 212 formed in a bottom wall 211 of the tank 20. In an end portion of the throat pipe 320, a suction port 321 which is an opening is formed on the other end. The throat pipe 320 presents an inverted U-shape in the entirety.

The nozzle 310 is fixed to an end portion of the throat pipe 320. As illustrated in FIG. 5, on an outer side surface of the end portion of the throat pipe 320, three fixing portions 325 each having a columnar shape protruding diagonally downward are formed. In each of the fixing portions 325, a female screw portion 325*a* is formed. On the other hand, in the nozzle 310, a protruding portion 312 protruding outward at a position corresponding to the fixing portion 325 is formed. In each of the protruding portions 312, a through hole 312*a* is formed. By screwing three screws 326 arranged in the through holes 312*a* with female screw portions 325*a* of the fixing portions 325, the nozzle 310 is fixed to the end portion of the throat pipe 320.

As described above, by fixing the nozzle 310 to the end portion of the throat pipe 320, even if the nozzle 310 injects water and receives a reaction force by the injection, a change of relative positions of the nozzle 310 and the throat pipe 320 can be suppressed. As a result, during the washing process which will be described later, the water injected by the nozzle 310 can be appropriately made to flow into the throat pipe 320 and the water can be supplied as the washing water to the toilet stool body 10.

Moreover, the three screws 326 fix a guide member 530 to the end portion of the throat pipe 320 with the nozzle 310. For example, by fixing the nozzle 310 on the basis of the throat pipe 320 and by fixing the guide member 530 on the basis of the tank 20, there is a concern that a relative positional relationship among the throat pipe 320, the nozzle 310, and the guide member 530 deviates from the one determined in design due to a manufacture error when the throat pipe 320 and the tank 20 are manufactured. On the other hand, by fixing both of the nozzle 310 and the guide member 530 to the end portion of the throat pipe 320, the respective relative positional relationships can be reliably made the one determined in design. The configuration and functions of the guide member 530 will be described later.

A specific shape of the throat pipe 320 will be described in more detail. The throat pipe 320 has a rising portion 322 extending diagonally upward from the suction port 321, a bent portion 323 arranged on a downstream side (upper side) of the rising portion 322, and a descending portion 324 arranged on a downstream side (lower side) of the bent portion 323 and extending downward from the bent portion 323.

The rising portion 322 is a cylindrical pipe having a uniform pipe diameter over the entirety and is arranged in a state tilted to a horizontal plane. The suction port 321 is formed on a lower end of the rising portion 322. The suction port 321 is formed so that the entirety of the edge thereof goes along the horizontal plane (in parallel with the horizontal plane).

The descending portion 324 is a cylindrical pipe having a uniform pipe diameter over the entirety and is arranged along the vertical direction. The pipe diameter of the descending portion 324 is larger than the pipe diameter of the rising portion 322. The pipe diameter of the bent portion 323 on the rising portion 322 side is equal to the pipe diameter of the rising portion 322. Moreover, the pipe diameter of the bent portion 323 on the descending portion 324 side is equal to the pipe diameter of the descending portion 324. Thus, the rising portion 322 and the descending portion 324 with the pipe diameters different from each other are smoothly connected by the bent portion 323.

In the rising portion 322, at a position substantially at the center along its channel direction, an air introduction pipe 330 is connected. The air introduction pipe 330 is a pipe having a cylindrical shape arranged along the vertical direction. A lower end of the air introduction pipe 330 is connected to an upper surface side of the rising portion 322, and the internal space of the air introduction pipe 330 communicates with the internal space of the rising portion 322. In an upper end of the air introduction pipe 330, an introduction port 331 is opened/formed, and it is so configured that air or water flowing through the introduction port 331 passes through the air introduction pipe 330 and can flow into the internal space of the rising portion 322. A position (height) of the introduction port 331 is such a position that is higher than the suction port 321 and is sunk in the water when the tank 20 is filled with water.

Moreover, on the outer side surface of the throat pipe 320, an overflow pipe 350 is integrally formed. The overflow pipe 350 extends downward from an overflow port 351 opened in an upper end thereof along the descending portion 324 of the throat pipe 320. The overflow pipe 350 has a channel formed therein, and the channel is independent from the channel inside the throat pipe 320.

The throat pipe 320 and the overflow pipe 350 formed as above have their one ends connected to an inlet 131 of the conduit 130 in the toilet stool body 10. As a result, the water having flowed through the suction port 321 or the overflow port 351 flows through the throat pipe 320 and the overflow pipe 350 into the conduit 130 and is supplied to the bowl portion 110 and the trap portion 141.

Figure 6:
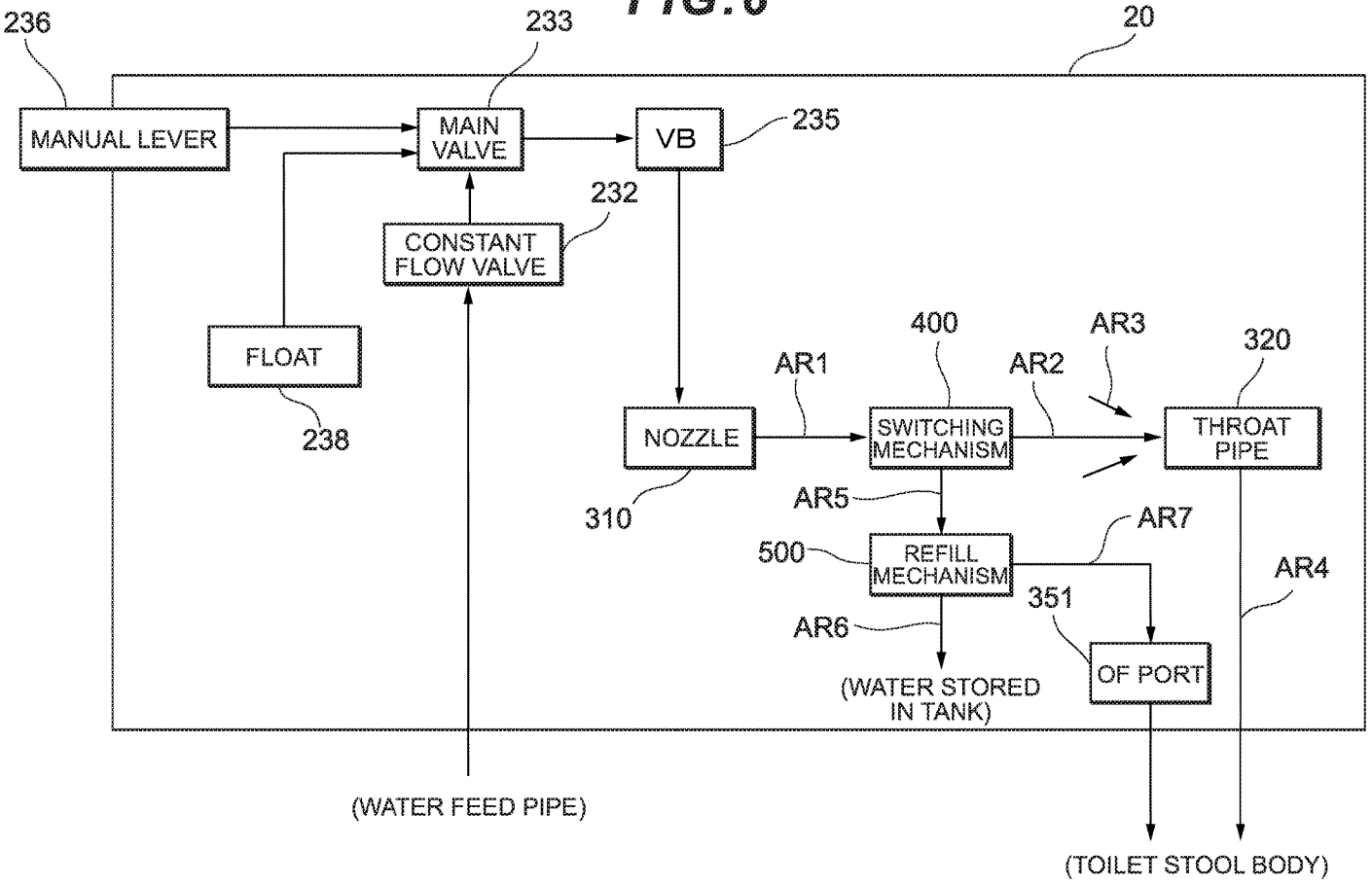
FIG. 6 is a block diagram illustrating a configuration inside the tank of the water closet device illustrated in FIG. 1.

Subsequently, by referring to FIG. 6, a flow of water inside the tank 20 will be described. FIG. 6 schematically illustrates the configuration inside the tank 20. As described above, inside the tank 20, the water feed pipe 231, the main valve 233, and the jet pump unit 300 are arranged.

In a standby state in which the water is not supplied into the toilet stool body 10 or the tank 20, the tank 20 is full. When the user of the water closet device FT operates the manual lever 236, the main valve 233 enters an open state as described above, and the washing process is started.

During the washing process, water is injected from the injection port 311 of the nozzle 310 (arrow AR1 in FIG. 6). The water injected by the nozzle 310 during the washing process passes without interfering with the switching mechanism 400 and flows into the throat pipe 320 (arrow AR2 in FIG. 6). The water stored inside the tank 20 is pulled into the throat pipe 320 (arrow AR3 in FIG. 6) and is supplied as the washing water to the toilet stool body 10 (arrow AR4 in FIG. 6).

When the washing process is finished, then, the tank water feeding process of supplying water to the tank 20 is started. During the tank water feeding process, the water injected by the nozzle 310 has its advancing direction switched by the switching mechanism 400 so as to be supplied into the tank 20 (arrow AR5 in FIG. 6). This water branches to water to be stored inside the tank 20 (arrow AR6 in FIG. 6) and water to be supplied to the overflow port 351 (arrow AR7 in FIG. 6) through the refill mechanism 500. As a result, the water level inside the tank 20 gradually rises. Moreover, the water supplied to the water to be supplied to the overflow port 351 is supplied to the conduit 130 of the toilet stool body 10. As a result, water is supplied to the trap portion 141 and stored, whereby the sealing water WT is restored.

By means of the tank water feeding process, a water level inside the tank 20 rises, and when the tank 20 becomes full, the pilot valve 234 is closed by a float 238 which has risen. As a result, the main valve 233 is closed, the supply of water to the tank 20 and the toilet stool body 10 is finished, and the state returns to standby.

Figure 7A:
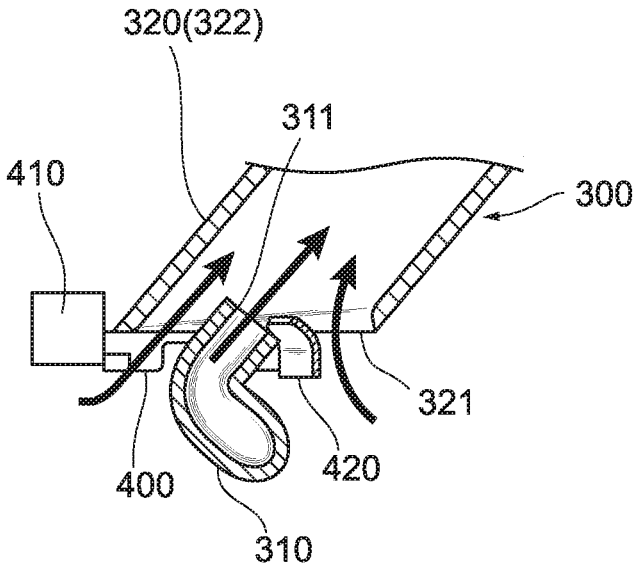
FIGS. 7A and 7B are views for explaining an operation of a jet pump unit of the water closet device illustrated in FIG. 1, in which FIG. 7A schematically illustrates a state in which a jet pump action is induced, and FIG. 7B schematically illustrates a state in which the jet pump action is not induced.
Figure 8:
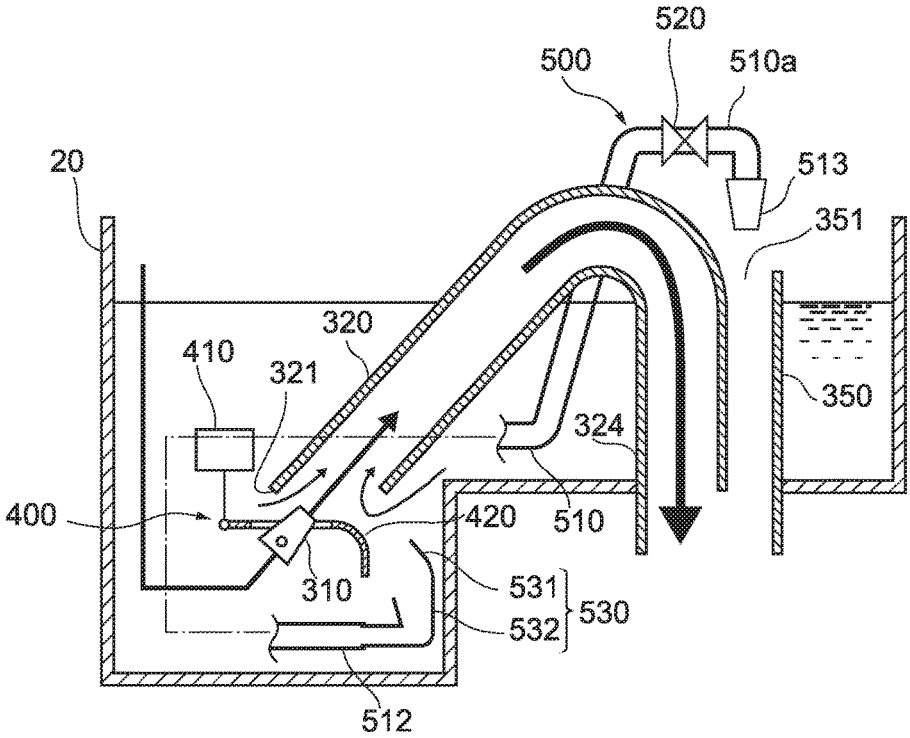
FIG. 8 is a view illustrating a flow of water inside the tank in a washing process of the water closet device illustrated in FIG. 1.

Subsequently, by referring to FIGS. 7A and 8, the configuration of the jet pump unit 300 and the operation during the washing process will be further described. FIG. 7A schematically illustrates a state in which a jet pump action is induced. FIG. 8 schematically illustrates a flow of water during the washing process.

In the aforementioned washing process, as illustrated in FIGS. 7A and 8, in a state in which the water level inside the tank 20 is higher than the suction port 321, water is injected from the nozzle 310, and the jet pump action is induced. The high-speed water injected by the nozzle 310 flows toward the inside of the rising portion 322 of the throat pipe 320. Moreover, a part of the rising portion 322 on a lower side and the nozzle 310 are sunk in the water stored in the tank 20. Thus, the water stored in the tank 20 is pulled into the rising portion 322 by the high-speed water injected from the injection port 311. As the result of induction of such jet pump action, inside the throat pipe 320, not only the water injected from the injection port 311 of the nozzle 310 but also the water pulled from the periphery of the suction port 321 flows. The water flows through the conduit 130 of the toilet stool body 10 and is supplied as the washing water to the rim portion 120 from the water discharge portions 133 and 135.

As described above, in the water closet device FT, a flow rate of the water supplied to the rim portion 120 is larger than a flow rate of the water injected from the injection port 311 of the nozzle 310. In other words, even if the flow rate of the water injected from the injection port 311 of the nozzle 310 is small, water in a sufficient flow rate as the washing water is supplied to the rim portion 120. Thus, even if the water closet device FT is installed in an environment with a small and low water pressure of the water pipe, sufficient washing performances can be exerted.

In the vicinity of the lower end of the rising portion 322, that is, in the vicinity of the suction port 321, the switching mechanism 400 is mounted. The switching mechanism 400 presents a rod shape as the whole and has a float 410 on one end along its longitudinal direction and a switching plate 420 on the other end.

In the switching mechanism 400, a portion between the float 410 and the switching plate 420 is mounted rotatably with respect to the vicinity of the lower end of the rising portion 322. As illustrated in FIG. 7A, if the water level inside the tank 20 is higher than the suction port 321, a buoyancy acting on the float 410 rotates the switching mechanism 400. Specifically, the float 410 moves upward, and the switching plate 420 moves downward with that and they stop at positions illustrated in FIG. 7A, respectively.

In a state in FIG. 7A, since an upper part of the nozzle 310 is not covered by the switching plate 420, the water injected from the nozzle 310 flows into the throat pipe 320 from the suction port 321 without directly hitting the switching plate 420. As a result, the jet pump action as described above is induced, and water as the washing water is supplied to the rim portion 120 of the toilet stool body 10.

Since the water inside the tank 20 is supplied to the rim portion 120, the water level inside the tank 20 gradually lowers. When the water level inside the tank 20 lowers to a predetermined position, the aforementioned tank water feeding process is performed.

Figure 7B:
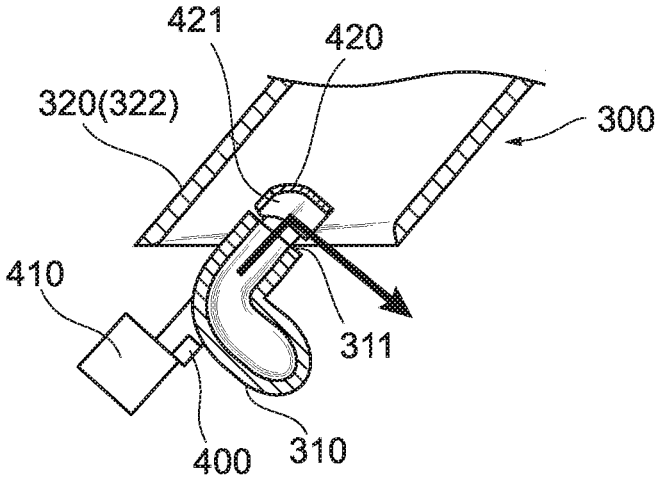
Figure 9:
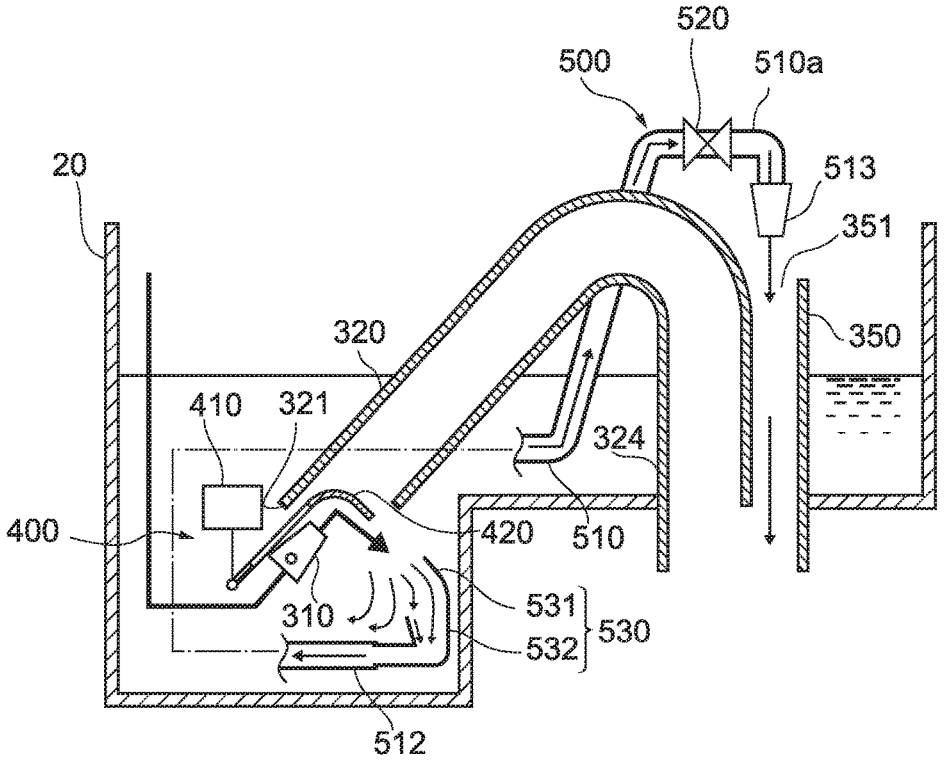
FIG. 9 is a view illustrating the flow of the water inside a tank during a tank water feeding process of the water closet device illustrated in FIG. 1.
Figure 10:
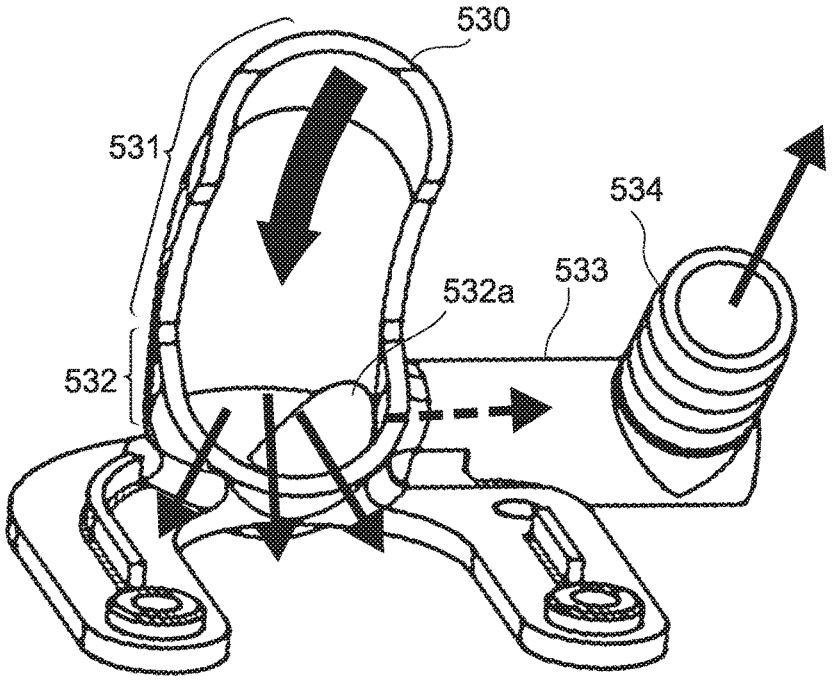
FIG. 10 is a perspective view illustrating a guide member of the water closet device illustrated in FIG. 1.
Figure 11:
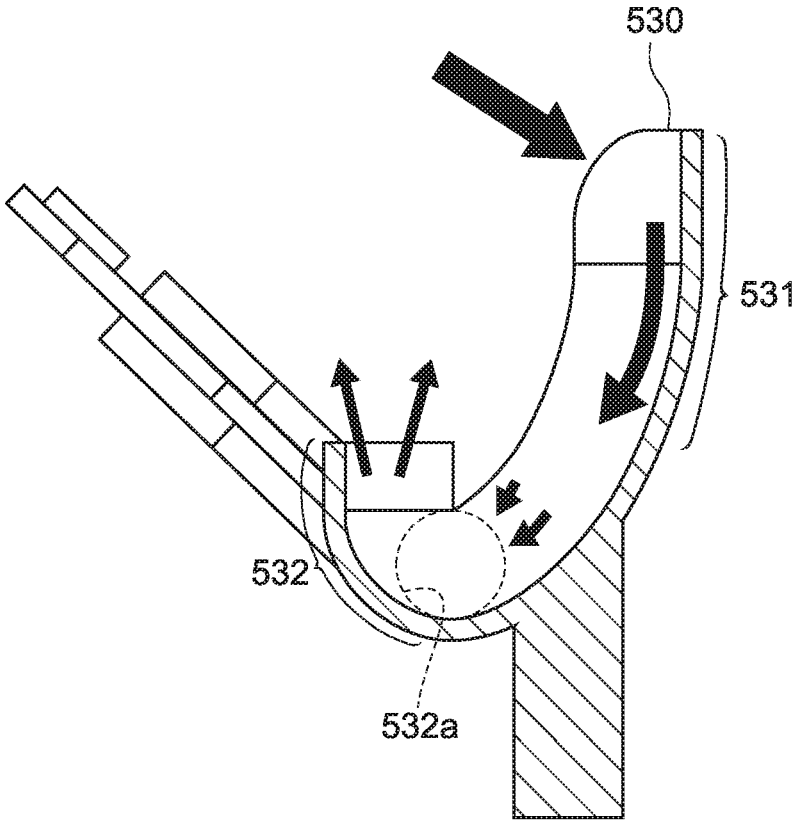
FIG. 11 is a sectional view illustrating the guide member of the water closet device illustrated in FIG. 1.

Subsequently, by referring to FIG. 7B and FIGS. 9 to 11, the operation of the jet pump unit 300 during the tank water feeding process will be described. FIG. 7B schematically illustrates a state in which the jet pump action is not induced. FIG. 9 schematically illustrates a flow of water during the tank water feeding process. FIG. 10 is a perspective view illustrating the guide member 530. FIG. 11 is a sectional view when the guide member 530 is cut on a plane perpendicular to the right-and-left direction.

During the tank water feeding process, as illustrated in FIGS. 7B and 9, in a state in which the water level inside the tank 20 has lowered from full, the water level is restored by the water injected by the nozzle 310. When the water level inside the tank 20 lowers to the vicinity of the suction port 321, the buoyancy acting on the float 410 becomes smaller. Thus, as illustrated in FIG. 7B, the float 410 moves downward and the switching mechanism 400 rotates. As a result, the switching plate 420 moves to a position covering an upper part of the nozzle 310 and the water injected by the nozzle 310 begins to directly hit the switching plate 420.

On the outer side surface of the switching plate 420, a surface 421 faced with the injection port 311 of the nozzle 310 has a recessed curved shape. When the water injected from the nozzle 310 hits the surface 421, the water flows along the curve of the surface 421, and its advancing direction is switched to one direction changed by approximately 90 degrees. As a result, the water injected from the nozzle 310 does not flow into the rising portion 322 any longer. As described above, the switching mechanism 400 switches the advancing direction of the water injected from the nozzle 310 from the toilet stool body 10 to the inside of the tank 20.

That is, since the advancing direction of the water injected from the nozzle 310 is switched to the inside of the tank 20, the water level inside the tank 20 is restored, and buoyancy acts on the float 410. The buoyancy acts so as to return the switching mechanism 400 to a state in FIG. 7A. However, the switching mechanism 400 resists the buoyancy by the force received by the switching plate 420 from the water and is held at the position illustrated in FIG. 7B until the tank 20 becomes full.

During the tank water feeding process, a part of the water injected from the nozzle 310 and whose advancing direction is switched by the switching mechanism 400 is stored inside the tank 20, while the other part is supplied by the refill mechanism 500 to the toilet stool body 10. The refill mechanism 500 has a refill pipe 510 and the guide member 530.

The refill pipe 510 is a tubular member having a channel formed therein. The refill pipe 510 is arranged with an inflow port 512 which is one end thereof is sunk in the water stored inside the tank 20. Moreover, the refill pipe 510 has a curved portion 510*a* arranged above the water level when the tank 20 is full, and on an end portion of this curved portion 510*a*, an outflow port 513 is formed. The outflow port 513 is arranged so as to be faced with the overflow port 351 above the overflow pipe 350.

The guide member 530 is, as illustrated in FIGS. 10 and 11, a tubular member molded by a resin material and has a guide wall 531, a collecting portion 532, a connecting portion 533, and a refill pipe connecting portion 534. The guide wall 531 has a curved surface recessed in the advancing direction of the water advancing from the switching mechanism 400 and is formed by protruding upward. The collecting portion 532 is linked with a lower end portion of this guide wall 531 and is formed with an upper part open and has a tapered shape with its diameter gradually reduced toward a lower part. In a side surface of the collecting portion 532, a penetrating communication port 532*a* is formed. The connecting portion 533 is formed having a tubular shape and is connected to the side surface of the collecting portion 532 so as to communicate with the communication port 532*a*. The refill pipe connecting portion 534 protrudes upward from the outer side surface of the connecting portion 533 and is a tubular portion formed having a multistage tapered shape. This refill pipe connecting portion 534 is fitted in the inflow port 512 of the refill pipe 510 and is connected to the refill pipe 510 so that a channel from the guide wall 531 to the inside of the refill pipe 510 is formed.

As illustrated in FIG. 9, the guide member 530 is arranged at a position capable of receiving the water injected from the nozzle 310 during the tank water feeding process. Specifically, the guide member 530 is arranged so that the water injected from the nozzle 310 and whose advancing direction is switched by the switching mechanism 400 is faced with the guide wall 531. A part of the water flowing from the switching mechanism 400 toward the guide member 530 deviates from the guide member 530 and flows, the other part flows along the curved surface of the guide wall 531 and is led to the collecting portion 532 below. The part of the water which deviates from the guide member 530 and flows is stored inside the tank 20 and restores the water level inside the tank 20.

On the other hand, the water led to the collecting portion 532 is then, flows through the channel inside the collecting portion 532. As described above, the channel is formed having a tapered shape. The water having passed through the collecting portion 532 reaches the refill pipe connecting portion 534 through the connecting portion 533 and flows into the refill pipe 510.

The water having flowed into the refill pipe 510 flows therethrough and reaches a flow control valve 520 provided on the curved portion 510*a* of the refill pipe 510. The flow control valve 520 is an opening/closing valve for adjusting an opening degree of the channel inside the refill pipe 510. The water flowing through the refill pipe 510 has its flow rate adjusted by this flow control valve 520 and reaches the outflow port 513. The flow rate of the water supplied by the refill pipe 510 to the toilet stool body 10 can be changed in accordance with a type of the toilet stool body 10 or its installation site, but by providing the flow control valve 520, its flow rate can be adjusted to be appropriate.

The water having reached the outflow port 513 is discharged toward the overflow port 351 below that. As described above, the overflow pipe 350 has its one end connected to the inlet 131 of the conduit 130 in the toilet stool body 10. Thus, the water discharged through the outflow port 513 and flowing into the overflow pipe 350 through the overflow port 351 reaches the conduit 130 of the toilet stool body 10. As a result, the water is supplied to the trap portion 141 through the rim portion 120 of the toilet stool body 10 and stored therein, whereby the sealing water WT is restored.

As described above, in this embodiment, the switching mechanism 400 is for switching the advancing direction of the water injected by the nozzle 310, and the position is held by receiving the force from the water during the tank water feeding process. Moreover, the refill mechanism 500 is for restoring the sealing water WT by leading the water whose advancing direction is switched during the tank water feeding process to the toilet stool body 10 by the refill pipe 510. Since the refill pipe 510 leads the water to the toilet stool body 10 without flowing through the suction port 321 of the throat pipe 320, such a situation does not occur that the switching mechanism 400 receives the force from this water and the force for holding the switching mechanism 400 at the position illustrated in FIG. 7(B) lowers. As a result, during the tank water feeding process, the force by the water injected from the nozzle 310 can be efficiently used for holding of the switching mechanism 400, the water whose advancing direction is switched is rapidly supplied to the toilet stool body 10, and the water feed into the tank 20 by the jet pump unit 300 and rapid restoration of the sealing water WT can be reliably performed.

Moreover, by providing the inflow port 512 below the water level when the tank 20 is full and by arranging at least a part of the refill pipe 510 above the water level when the tank 20 is full, discharge of the water stored inside the tank 20 through the refill pipe 510 can be suppressed during the time other than the tank water feeding process.

Moreover, during the tank water feeding process, the water whose advancing direction is switched by the switching mechanism 400 is subjected to large resistance due to a rapid change of a channel sectional area when flowing into the inflow port 512 of the refill pipe 510 and its flow rate lowers. Thus, by collecting the water by the collecting portion 532 formed having a tapered shape, the change of the channel sectional area is alleviated so as to make this resistance small, whereby lowering of the flow rate can be suppressed.

Moreover, the water injected by the nozzle 310 and whose advancing direction is switched by the switching mechanism 400 advances through the water stored in the tank 20 while being diffused. By means of such diffusion, a water force at the inflow port 512 of the refill pipe 510 is largely lowered and thus, there is a concern that the flow rate of the water that can be supplied as the sealing water WT to the toilet stool body 10 is lowered.

Thus, in this embodiment, the water injected by the nozzle 310 is made to flow along the outer side surface of the guide wall 531 and is led to the inflow port 512 of the refill pipe 510. As a result, diffusion of the water and the lowering of the water force at the inflow port 512 of the refill pipe 510 are suppressed, and the lowering of the flow rate of the water that can be supplied as the sealing water WT to the toilet stool body 10 can be suppressed.

Moreover, by switching of the advancing direction by the switching mechanism 400 so that the water injected from the nozzle 310 advances in one direction, that is, to the inflow port 512 side, the lowering of the water force at the inflow port 512 of the refill pipe 510 due to the diffusion can be suppressed as compared with the case in which the water is made to advance in multiple directions. As a result, the lowering of the flow rate of the water that can be supplied to the toilet stool body 10 can be suppressed.

Moreover, in this embodiment, during the tank water feeding process, the sealing water WT can be restored by supplying water having flowed into the refill pipe 510 from the overflow port 351 to the toilet stool body 10. That is, by using the overflow port 351 used for preventing overflow of the tank 20, the sealing water WT can be restored without providing a separate exclusive opening.

The embodiment of the present invention has been described by referring to specific examples. However, the present invention is not limited to these specific examples. That is, these specific examples to which those skilled in the art adds a design change as appropriate are also included in the scope of the present invention as long as the features of the present invention are provided. For example, each element and its arrangement, material, condition, shape, size and the like provided in each of the specific examples are not limited to those exemplified but can be changed as appropriate. Moreover, each of the element provided in each of the aforementioned embodiments can be combined as long as it is technically feasible, and a combination of them is also included in the scope of the present invention as long as the features of the present invention are included.

What is claimed is:

1. A water closet device in which a toilet stool body is washed by washing water, comprising:

a toilet stool body having a bowl portion for receiving waste and a trap portion for accepting the waste discharged from the bowl portion and storing water as sealing water;

a tank for storing water inside;

a jet pump unit arranged in a state at least partially sunk inside the tank, the jet pump unit including:

a throat pipe having a suction port formed and arranged to supply water that flows in through the suction port as the washing water to the toilet stool body, and a nozzle for injecting water toward the inside of the throat pipe through the suction port and inducing a jet pump action to thereby increase a flow rate of the water flowing through the throat pipe to more than the flow rate of the water injected by the nozzle;

a switching mechanism for switching an advancing direction of the water injected by the nozzle to thereby sequentially perform:

a washing process of increasing the flow rate of the water injected by the nozzle mainly by the jet pump unit and supplying the water as the washing water to the toilet stool body, and a tank water feeding process of supplying and storing the water injected by the nozzle mainly inside the tank; and a refill mechanism for supplying the sealing water to the toilet stool body during the tank water feeding process, wherein the switching mechanism is configured to switch the advancing direction by moving between a first position corresponding to the washing process and a second position corresponding to the tank water feeding process, the switching mechanism being held at the second position by a force received from the water injected by the nozzle during the tank water feeding process;

the refill mechanism has a refill pipe for causing the water injected from the nozzle during the tank water feeding process, and that had its advancing direction switched by the switching mechanism to flow in through an inflow port on one end side; and the refill pipe is configured to lead the water that flows in through the inflow port to the toilet stool body without flowing through the suction port of the throat pipe.

2. The water closet device according to claim 1, wherein the inflow port is positioned below a water level when the tank is full; and at least a part of the refill pipe is positioned above the water level when the tank is full.

3. The water closet device according to claim 2, wherein the refill mechanism has a collecting portion formed having a tapered shape for collecting the water that had its advancing direction switched by the switching mechanism and directing the water to the inflow port of the refill pipe.

4. The water closet device according to claim 2, wherein the refill mechanism has a guide wall for leading the water that had its advancing direction switched by the switching mechanism to the inflow port of the refill pipe.

5. The water closet device according to claim 2, wherein the switching mechanism switches the advancing direction at the second position so that the water injected from the nozzle advances in one direction.

6. The water closet device according to claim 2, wherein the tank has an overflow port through which the overflow water flows if water is supplied when the tank is full; and the tank is configured such that the water that flows into the refill pipe is supplied from the overflow port to the toilet stool body.

* * * * *